US009845660B2

(12) United States Patent
Ringgenberg

(10) Patent No.: US 9,845,660 B2
(45) Date of Patent: Dec. 19, 2017

(54) PRESSURE RESPONSIVE DOWNHOLE TOOL HAVING A SELECTIVELY ACTIVATABLE PRESSURE RELIEF VALVE AND RELATED METHODS

(71) Applicant: Halliburton Energy Services, Inc., Houston, TX (US)

(72) Inventor: Paul David Ringgenberg, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 328 days.

(21) Appl. No.: 14/438,555

(22) PCT Filed: Dec. 27, 2012

(86) PCT No.: PCT/US2012/071816

§ 371 (c)(1),
(2) Date: Apr. 24, 2015

(87) PCT Pub. No.: WO2014/105024

PCT Pub. Date: Jul. 3, 2014

(65) Prior Publication Data

US 2015/0247379 A1 Sep. 3, 2015

(51) Int. Cl.
*E21B 34/10* (2006.01)
*E21B 34/00* (2006.01)

(52) U.S. Cl.
CPC ..... *E21B 34/10* (2013.01); *E21B 34/108* (2013.01); *E21B 2034/002* (2013.01)

(58) Field of Classification Search
None
See application file for complete search history.

(56) References Cited

U.S. PATENT DOCUMENTS

| | | | | |
|---|---|---|---|---|
| 4,076,086 | A | 2/1978 | Evans | |
| 4,210,214 | A * | 7/1980 | Blanton | E21B 31/113 175/297 |
| 4,515,219 | A | 5/1985 | Beck | |
| 4,557,333 | A | 12/1985 | Beck | |
| 5,180,007 | A | 1/1993 | Manke et al. | |
| 5,209,303 | A | 5/1993 | Barrington | |
| 5,558,162 | A | 9/1996 | Manke et al. | |
| 5,597,016 | A * | 1/1997 | Manke | E21B 23/006 138/42 |
| 8,453,729 | B2 * | 6/2013 | Harris | E21B 23/01 166/120 |

(Continued)

OTHER PUBLICATIONS

Extended Search Report issued for European Patent Application No. 12891015 dated Oct. 7, 2016, 8 pages.

(Continued)

*Primary Examiner* — Brad Harcourt
*Assistant Examiner* — Steven Macdonald
(74) *Attorney, Agent, or Firm* — Haynes and Boone, LLP

(57) ABSTRACT

A pressure responsive downhole tool comprises a power piston pressure relief valve that is selectively activated and deactivated to allow pressure-related operations to be conducted. The pressure relief valve will not open until the power piston is activated, which also requires the operating element (ball valve, for example) to be opened, thereby avoided situations in which the ball valve is inadvertently placed in the Lock Open position.

19 Claims, 7 Drawing Sheets

(56) References Cited

U.S. PATENT DOCUMENTS

| | | | | |
|---|---|---|---|---|
| 2003/0183392 | A1* | 10/2003 | Garay | E21B 34/06 166/320 |
| 2005/0000693 | A1 | 1/2005 | Ravensbergen et al. | |
| 2012/0273055 | A1* | 11/2012 | Lirette | E21B 21/103 137/14 |

OTHER PUBLICATIONS

International Search Report and the Written Opinion of the International Searching Authority, or the Declaration, dated Sep. 4, 2013, PCT/US2012/071816, 9 pages, ISA/KR.

* cited by examiner

PRESSURE RESPONSIVE DOWNHOLE TOOL HAVING A SELECTIVELY ACTIVATABLE PRESSURE RELIEF VALVE AND RELATED METHODS

The present application is a U.S. National Stage patent application of International Patent Application No. PCT/US2012/071816, filed on Dec. 27, 2012, the benefit of which is claimed and the disclosure of which is incorporated herein by reference in its entirety.

FIELD OF THE INVENTION

The present invention relates generally to pressure responsive tools and, more specifically, to a pressure responsive downhole tool (e.g., drill stem tester valve) having an operating element (ball valve, for example) that is only open when a power piston pressure relief valve is activated.

BACKGROUND

Conventional tester valves, such as the Select Tester® Valve commercially offered by Halliburton Energy Services, Co., utilize a pressure relief valve in the power piston to control whether the annulus pressure application is considered to be a normal opening pressure or a Lock Open operating pressure. For example, in conditions of 12,000 psi hydrostatic pressure and 300° F., the normal operating pressure is approximately 1400 psi and the Lock Open pressure is roughly 1300 psi higher at 2700 psi.

Such designs can be problematic. For example, the pressure relief valve in the power piston is normally in the range of about 1250 psi. Thus, if the ball valve has high friction due to wear or high pressure differential, the pressure required to open the ball valve and unlatch the collets at the same time, could exceed the 1250 pressure relief in the piston. Therefore, instead of the ball valve opening, the tester valve will index forward into the Lock Open position. Ultimately, when the annulus pressure is bled off, the ball valve will still be closed; but, the selector will be in the Lock Open position. If this is the case, the operator will think the valve is normally closed when, actually, it never opened but, instead, has indexed to the Lock Open position.

Moreover, if the friction on the ball mechanism is between the 1250 psi pressure relief pressure and the applied operating pressure, the ball can be opened after the tool has indexed forward. When the annulus pressure is released, the tool will again be unexpectedly in the Locked Open position. Therefore, without ever going above the normal operating pressure, it is possible to put the tool in the Locked Open position. If the tester valve is being utilized to perform a downhole closure, it will not close. If an emergency happens and the tester valve is expected to close in the well downhole, again, it will not. It will require a pressure cycle to the high Lock Open value to return the tool to normal functioning. Such an operation may take 30 minutes minimum to perform.

Accordingly, in view of the foregoing, there is a need in the art for a tester valve having a pressure relief valve that is only active when the ball valve is in the open position. Therefore, if high pressure is required to get the ball open, the ball must open before the pressure relief valve can open and place the tool in the Lock open position. Such a tool would avoid inadvertent Lock Open positions whereby the operator believes that bleeding off the annulus pressure will close the ball, when in fact the tool is in the Locked Open position.

DESCRIPTION OF ILLUSTRATIVE EMBODIMENTS

Figure 1A:
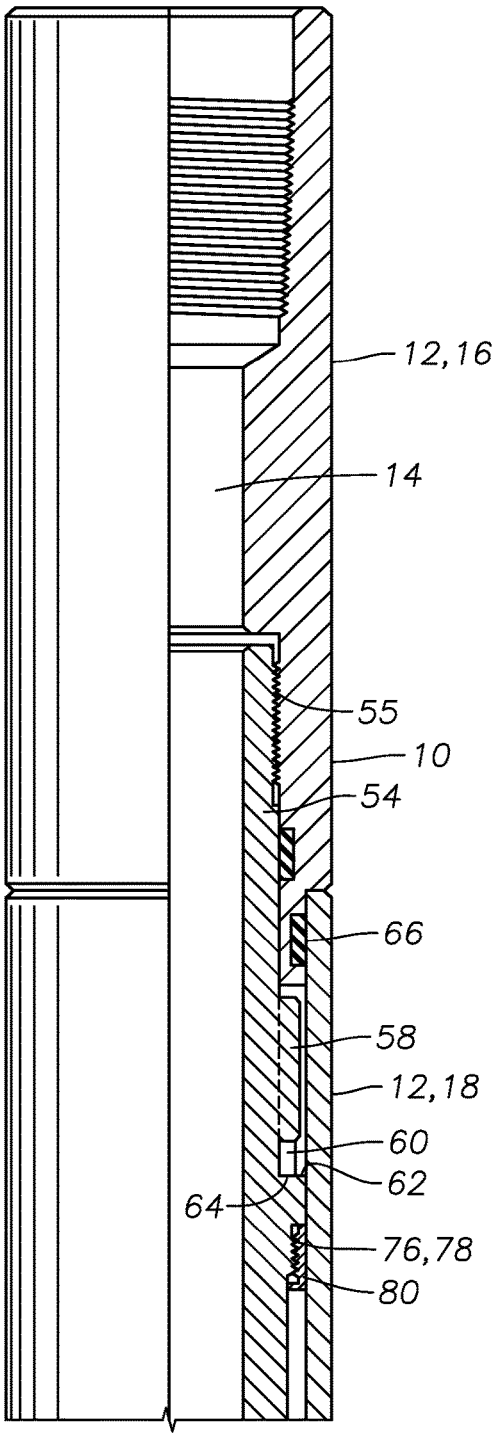
FIGS. 1A-1I are sectional views of an annular pressure responsive downhole tool having a selectively activatable pressure relief valve, in accordance to certain exemplary embodiments of the present invention.

Illustrative embodiments and related methodologies of the present invention are described below as they might be employed in a pressure responsive downhole tool having a selectively activatable power piston pressure relief valve. In the interest of clarity, not all features of an actual implementation or methodology are described in this specification. Also, the "exemplary" embodiments described herein refer to examples of the present invention. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the invention will become apparent from consideration of the following description and drawings.

As described herein, exemplary embodiments of the present invention are directed to a pressure responsive downhole tool having a power piston pressure relief valve that may be selectively deactivated and activated to allow operations to be conducted using the tool. The pressure responsive downhole tool may be a variety of tools, such as, for example, a tester valve as described in U.S. Pat. No. 5,558,162, entitled "MECHANICAL LOCKOUT FOR PRESSURE RESPONSIVE DOWNHOLE TOOL," also owned by the Assignee of the present invention, Halliburton Energy Services, Co. of Houston, Tex., the disclosure of which is hereby incorporated by reference in its entirety. As such, the inventive features described herein will be discussed in relation to a drill stem tester valve. However, those ordinarily skilled in the art having the benefit of this disclosure realize the present invention may be applied to any variety of pressure responsive tools.

As further described herein, exemplary embodiments of the pressure responsive tool include a power piston pressure relief valve having a vent port that vents between two annular seals positioned around the outer diameter of the power piston. In embodiments utilized within a drill stem tester valve, during downhole deployment of the tool, the ball valve assembly is in the closed position and the two seals of the power piston seal against the tool housing, thus maintaining the pressure relief valve in a deactivated position. As the ball valve is opened, annular pressure is applied to the power piston which moves the lower annular seal into a slot along the inner diameter of the tool housing, thus allowing pressure to vent around the seal to activate the pressure relief valve. Activation of the pressure relief valve can only happen if the ball valve is open. Thereafter, drill stem testing may be conducted as understood in the art. When it is desired to deactivate the pressure relief valve, the annular pressure is bled off and the power piston moves back to the deactivated position, which also actuates the ball valve back to the closed position. Accordingly, the pressure relief valve is only open when the ball valve is in the open position, thus avoiding any inadvertent Locked Open positions.

Referring now to FIGS. 1A-1I, an annular pressure responsive tool 10 will now be described in accordance to one or more exemplary embodiments of the present invention. As previously described, annular pressure responsive tool 10 may be, for example, a drill stem tester valve. For example, annular pressure responsive tool 10 may be used with a formation testing string during the testing of an oil well to determine production capabilities of a subsurface formation. The testing string will be lowered into a well such that a well annulus is defined between the test string and the well bore hole. A packer associated with the annular pressure responsive tool 10 will be set in the well bore to seal the well annulus below the power port 214 of valve 10, as hereinafter described in detail, which is then subsequently operated by varying the pressure in the well annulus.

Referring now to FIGS. 1A-1I of the present invention, the annular pressure responsive tool 10 includes a housing 12 having a central flow passage 14 disposed longitudinally therethrough. Housing 12 includes an upper adapter 16, a valve housing section 18, a ported nipple 20, power housing section 22, connector section 24, an upper gas chamber housing section 26, a gas filler nipple 28, a lower gas chamber housing section 30, a metering cartridge housing 32, a lower oil chamber housing section 34 and a lower adapter 36. The components just listed are connected together in the order listed from top to bottom with various conventional threaded and sealed connections. The housing 12 also includes an upper inner tubular member 38, an inner connector 40, and a lower inner tubular member 42. Upper inner tubular member 38 is threadedly connected to gas filler nipple 28 at thread 44 and sealingly received within bore 46 to be affixed to inner connector 40 below. Lower gas chamber housing 30 is attached to inner connector 40 at thread 47. O-ring seals 49 seal the connections, as understood in the art. Lower inner tubular member 42 is threadedly connected to inner connector 40 at thread 48. Lower inner tubular member 42 is sealingly received within a bore 50 of lower adapter 36 with an O-ring seal 52 being provided therebetween.

An upper seat holder 54 is threadedly connected to upper adapter 16 at thread 56. Upper seat holder 54 has a plurality of radially outward extending splines 58 which mesh with a plurality of radially inward extending splines 60 of valve housing section 18. Upper seat holder 54 includes an annular upward facing shoulder 62 which engages lower ends 64 of splines 60 of valve housing section 18 to thereby hold valve housing section 18 in place with the lower end of upper adapter 16 received in the upper end of valve housing section 18 with a seal 66 being provided therebetween. An annular upper valve seat 68 is received in upper seat holder 54, and a spherical ball valve (i.e., operating element) 70 engages upper seat 68. Ball valve 70 has a bore 72 disposed therethrough. In FIG. 1, ball valve 70 is shown in its open position so that the bore 72 of ball valve 70 is aligned with the longitudinal flow passage 14, or bore, of annular pressure responsive tool 10. As will be further described below, when ball valve 70 is rotated to its closed position, the bore 72 is isolated from the central flow passage 14 of annular pressure responsive tool 10.

In this exemplary embodiment, ball valve 70 is held between upper seat 68 and a lower annular seat 74. Lower annular seat 74 is received in a lower seat holder mandrel 76. The lower seat holder mandrel 76 is a cylindrical cage-like structure having an upper end portion 78 threadedly connected to upper seat holder 54 at thread 80 to hold the two together with the ball valve 70 and seats 68,74 clamped therebetween. A spring 82 (Belleville spring, for example) is located below lower seat 74 to provide the necessary resilient clamping of the ball valve 70 between seats 68 and 74.

Figure 1B:
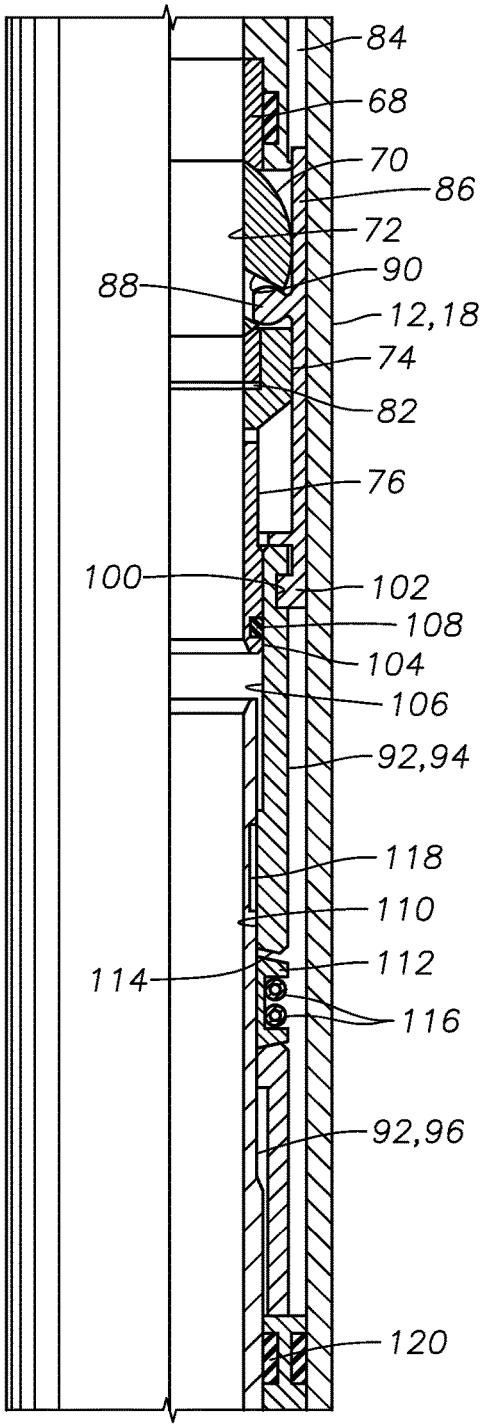

Cylindrical cage-like lower seat holder 76 has two longitudinal slots, one of which is visible in FIG. 1B and designated by the numeral 84. Within each of the slots, such as 84, there is received an actuating arm such as the one visible in FIG. 1B and designated as 86. Actuating arm 86 has an actuating lug 88 disposed thereon which engages an eccentric bore 90 disposed through the side of ball valve 70 so that the ball valve 70 may be rotated to a closed position upon upward movement of actuating arm 86 relative to the housing 12, as seen in FIG. 1B. Although not shown, there are two such actuating arms 86 with lugs 88 engaging two such eccentric bores such as 90. Further details regarding the operation of ball valve 70 will be understood by those ordinarily skilled in the art having the benefit of this disclosure.

An operating mandrel assembly 92 includes an upper operating mandrel portion 94, and intermediate operating mandrel portion 96, and a lower operating mandrel portion 98. As shown in FIG. 1B, upper operating mandrel portion 94 includes a radially outer annular groove 100 disposed therein which engages a radially inwardly extending shoulder 102 of actuating arm 86 so that actuating arm 86 reciprocates with the upper operating mandrel portion 94 within the housing 12 to move ball valve 70 between the open and closed positions. Lower seat holder mandrel 76 has an outer surface 104 closely received within an inner cylindrical bore 106 of the upper operating mandrel portion 94 with a seal being provided therebetween by annular seal 108. An upper portion of intermediate operating mandrel portion 96 is received within a smaller bore 110 of upper operating mandrel portion 94. Upper operating mandrel portion 94 carries a plurality of locking dogs 112 each disposed through a radial window 114 in upper operating mandrel portion 94 with a plurality of annular biasing springs 116 received about the radially outer sides of locking dogs 112 to urge them radially inward through the windows 114 against the intermediate operating mandrel portion 96.

Operating mandrel assembly 92 is seen in FIGS. 1A-1F, where annular pressure responsive tool 10 is in an initial run-in open position wherein the ball valve 70 is open as shown. However, as will also be described herein, annular pressure responsive tool 10 may also be initially run into the well with the ball valve 70 in a closed position. When in the initial run in closed position, intermediate operating mandrel portion 96 carries an annular radial outer groove 118, which in FIG. 1B is shown displaced above locking dogs 112. Intermediate operating mandrel portion 96 slides freely relative to upper operating mandrel portion 94 until locking dogs 112 are received within annular groove 118. Thus, referring to FIG. 1B, annular pressure responsive tool 10 could be initially assembled with upper operating mandrel portion 94 displaced upwardly relative to housing 12 and intermediate operating mandrel portion 96 from the position shown in FIG. 1B such that locking dogs 112 are received and locked in place in groove 118 with ball valve 70 rotated to a closed position.

Intermediate operating mandrel portion 96 is closely slidably received within a bore 119 of ported nipple 20 with an O-ring seal 120 being provided therebetween. Intermediate operating mandrel portion 96 includes a radially outwardly extending flange 122. An annular mud chamber 130 is defined between ported nipple 20 and intermediate operating mandrel portion 96. One or more power ports 132 are radially disposed through ported nipple 20 to communicate a well annulus surrounding annular pressure responsive tool 10 with mud chamber 130. An annular oil power chamber 134 is defined between power housing section 22 and intermediate operating mandrel portion 96. An actuating piston 136 is slidably received within annular oil power chamber 134 with an outer seal 138 sealing against power housing section 22 and an inner seal 140 sealing against intermediate operating mandrel portion 96. Actuating piston 136 includes an upper side 133 and lower side 135.

Actuating piston 136 serves to isolate well fluid (e.g., mud) entering power port 132 from hydraulic fluid (e.g., oil) contained in oil power chamber 134. Actuating piston 136 is connected at lower threads 124 to load transfer sleeve 126 which presents four inwardly protruding load transfer shoulders proximate its lower end. One of these shoulders is shown at 128 in FIG. 1C, which also includes upwardly facing contact surfaces 128*a*. A bearing race (not shown) of slightly enlarged diameter is disposed about the inner circumference of the load transfer sleeve 126. A bearing insertion aperture (also not shown) is disposed through the load transfer sleeve 126 proximate the bearing race. Split ring 139 and shoulder 147 fixedly surround the intermediate operating mandrel portion 96 and limit upward axial movement of the ratchet sleeve 127 with respect to the intermediate operating mandrel portion 96. A snap ring 149 fixedly surrounds the intermediate operating mandrel portion 96 proximate the lower end of the ratchet sleeve 127 to limit downward axial movement of the ratchet sleeve 127.

Figure 1C:
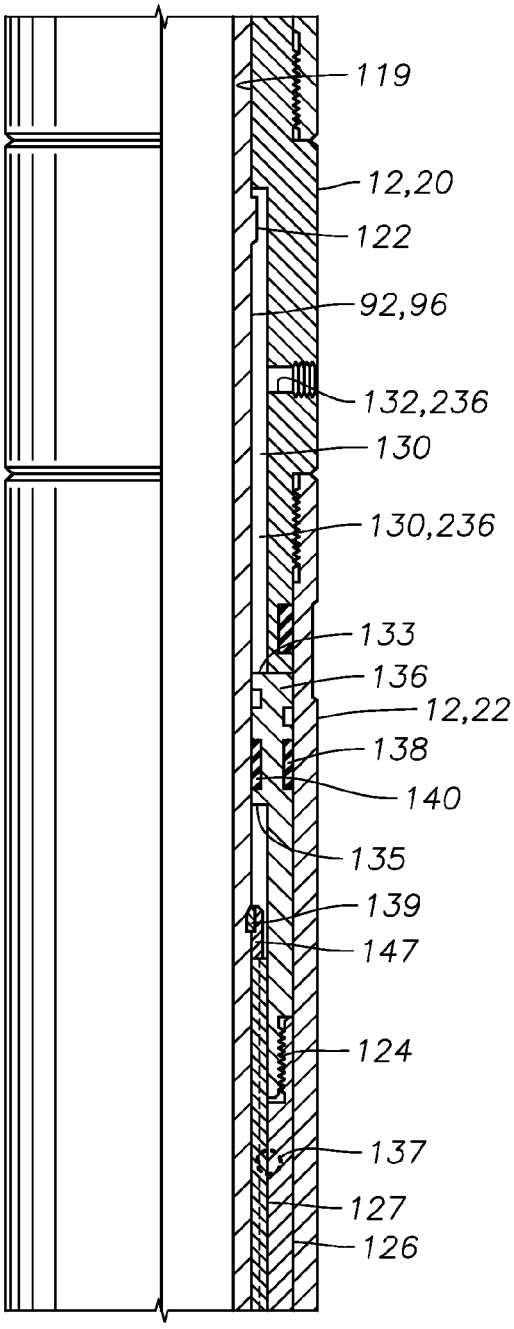
Figure 3:
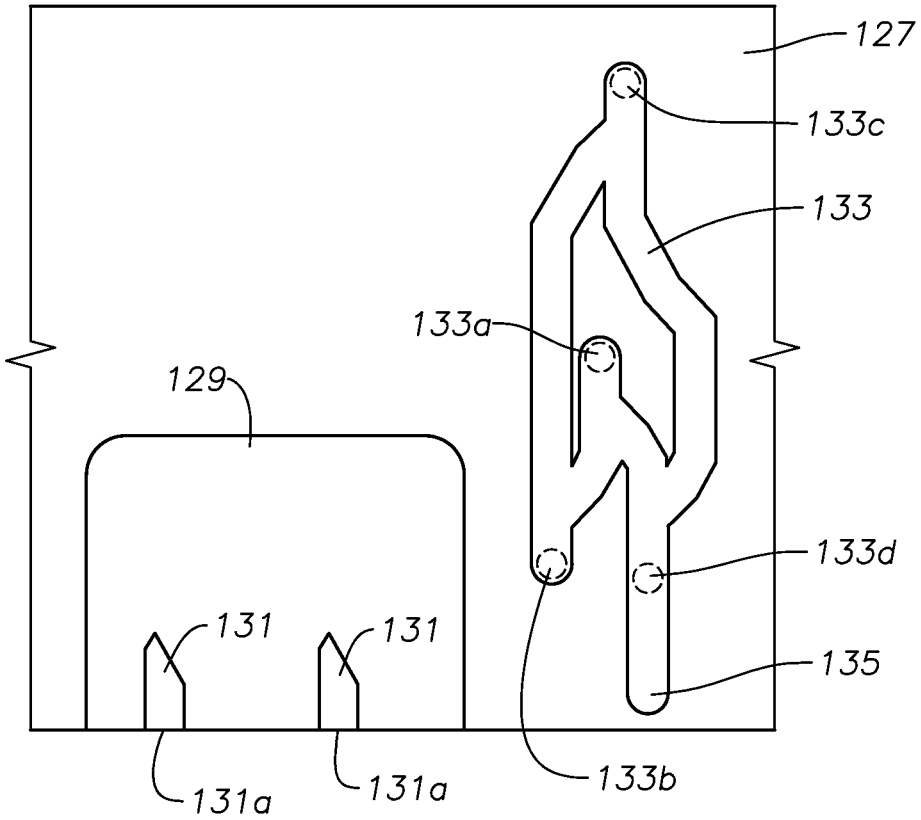
FIG. 3 is an exterior view of a portion of a ratchet sleeve constructed in accordance to certain exemplary embodiments of the present invention.

Referring now to FIGS. 1C and 3, ratchet sleeve 127 surrounds the intermediate operating mandrel portion 96 and is loosely received within load transfer sleeve 126. Ratchet sleeve 127 is axially rotatable upon the intermediate mandrel portion 96. The outer surface of an exemplary ratchet sleeve 127 is shown in FIG. 3. A milled out area 129 is located proximate the lower end and upon the outer circumference of ratchet sleeve 127. Milled out area 129 is a section of sufficiently reduced thickness on ratchet sleeve 127 to permit load transfer shoulders 128 of the load transfer sleeve 126 to be moved freely adjacent thereto. Load bearing shoulders 131 which present downwardly facing contact surfaces 131 are provided proximate the lower end of ratchet sleeve 127. In certain exemplary embodiments, there are four outward load bearing shoulders 131*a* disposed about the outer circumference of ratchet sleeve 127 positioned so as to be in complimentary engagement with load transfer shoulders 128 of load transfer sleeve 126. Bearing slot grooving 133 is provided on the outer circumference of the ratchet sleeve 127 which is shaped and sized to receive a bearing. Bearing slot grooving 133 includes a first bearing stop position 133*a*, a second bearing stop position 133*b*, third bearing stop position 133*c* and fourth bearing stop position 133*d*, as shown in the dotted lines in FIG. 3.

Bearing installation grooving 135 is provided which is deeper than the bearing slot grooving 133. In certain exemplary embodiments, there may be two arrangements of bearing slot grooving 133 located on opposing sides of the ratchet sleeve 127. Similarly, there would be two such milled out areas 129 with protruding load bearing shoulders 131. While load transfer shoulders 128 are engaged with load bearing shoulders 131 of ratchet sleeve 127, upward axial load may be transmitted to the ratchet sleeve 127, shoulder 147 and intermediate operating mandrel portion 96 such that the ball valve 70 may be closed by an upward pressure differential upon the lower side 135 of actuating piston 136. Upward loading on the actuating piston 136 causes the load transfer sleeve 126 to transfer its upward load through the engagement of load transfer shoulders 128 and load bearing shoulders 131 to ratchet sleeve 127, shoulder 147 and, thereby, to operating mandrel assembly 92.

Still referring to FIGS. 1C and 3, ratchet sleeve 127 and load transfer sleeve 126 are operatively associated as a ratchet assembly by insertion of a bearing 137 into the insertion aperture when the insertion aperture is aligned with the installation grooving 135 of the ratchet sleeve 127. By manipulating ratchet sleeve 127, bearing 137 is then captured and moved within the bearing race and the bearing slot grooving 133. In operation, the arrangement functions as a selectively actuatable load transfer assembly which provides for translation of axial motion by the load transfer sleeve 126 as movement of bearing 137 along bearing slot grooving 133 rotates ratchet sleeve 127 with respect to the load transfer sleeve 126, and selectively brings load transfer shoulders 128 of load transfer sleeve 126 into engagement with load bearing shoulders 131 of ratchet sleeve 127. Operation of such a ratchet assembly to selectively actuate actuating arm 86 and ball valve 70 between various open positions will be readily understood by those ordinarily skilled in the art having the benefit of this disclosure.

Figure 1D:
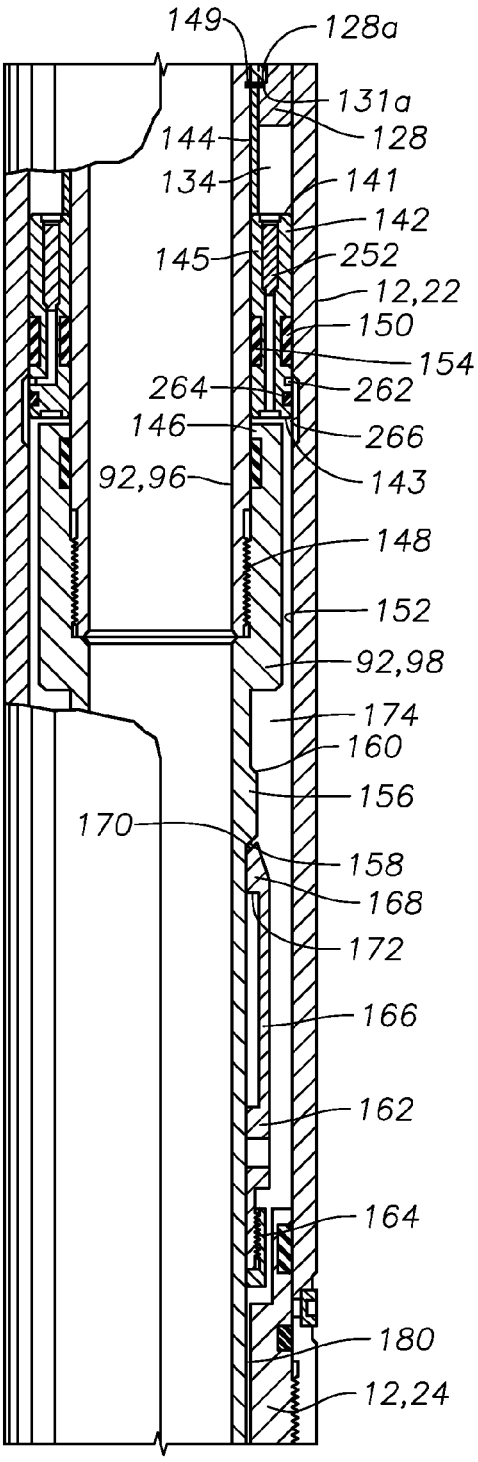

Referring now to FIG. 1D, an exemplary embodiment of an annular power piston 142 will now be described. Note that annular power piston 142 is illustrated in the activated position, whereby ball valve 70 is also in the open position. However, as will be described below, in one exemplary methodology, annular pressure responsive tool 10 is run downhole having ball valve 70 in the closed position and annular power piston 142 is the deactivated position. Nevertheless, as shown in FIG. 1D, annular power piston 142 is fixedly attached to the operating mandrel assembly 92 and is held in place between by a sleeve 144 mounted between upper side 141 of power piston 142 and the lower end of shoulder 128. Intermediate operating mandrel portion 96 and lower operating mandrel portion 98 are threadedly connected at thread 148 after the power piston 142 has been placed about the intermediate operating mandrel portion 96 below the sleeve 144.

In addition, power piston 142 has a shoulder 145 which engages sleeve 144 positioned around intermediate operating mandrel portion 96. Power piston 142 has an upper side 141 and a lower side 143. Power piston 142 also carries an outer annular seal 150 which provides a sliding seal against the wall of an inner cylindrical bore 152 (i.e., power housing section 22) and an inner annular seal 154 which seals against the intermediate operating mandrel portion 96.

Power piston 142 includes a pressure relief valve 250 and check valve 252, both of which combine to form a fluid transfer assembly that permits fluid transfer across power piston 142. Pressure relief valve 250 provides sufficient resistance so that it will not open to relieve pressure until the annulus has been overpressured to a second level which is above the first pressure level needed to move power piston 142 and ball valve 70 between the closed and open positions. Pressure relief valve 250 is thereby set such that it will not open during normal operation of annular pressure responsive tool 10. Thus, if annular pressure responsive tool 10 is normally operated by increasing well annular pressure to, for example, 1,000 psi above hydrostatic well annulus pressure, pressure relief valve 250 is designed to require greater than 1,000 psi to open.

However, in exemplary embodiments of the present invention, pressure relief valve 250 must first be activated in order to relieve the pressure once the rated pressure level has been exceeded. As described herein, pressure relief valve is "deactivated" when, despite the rated pressure being exceeded, pressure relief valve does not function to allow relief of pressure therethrough. As a corollary, "activated" describes the state of pressure relief valve 250 whereby it is allowed to relieve the pressure once the rated level has been exceeded.

Figure 2:
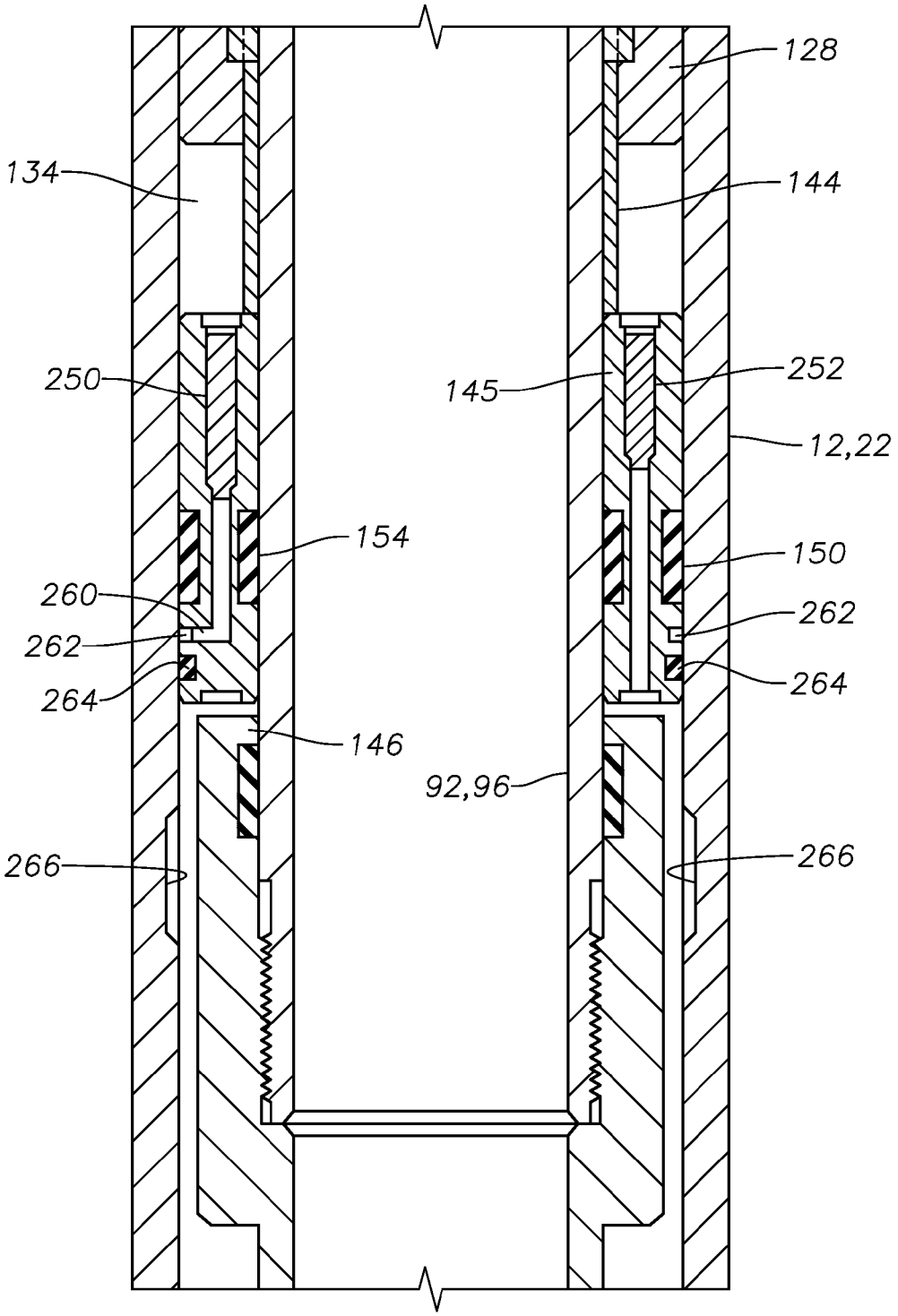
FIG. 2 illustrates an exploded view of a power piston having a selectively activatable pressure relief valve, in accordance to certain exemplary embodiments of the present invention.

To further illustrate this feature of the present invention, FIG. 1D shows power piston 142 and pressure relief valve 250 in the activated position, while FIG. 2 illustrates the deactivated position. As previously mentioned, in certain exemplary methodologies, annular pressure responsive tool 10 is run downhole with power piston 142 in the deactivated position and ball valve 70 in the closed position, as shown in FIG. 2. To achieve this objective, pressure relief valve 250 includes a vent port 260 that vents along the outer diameter of power piston 142. In this example, vent port 260 is a one-way vent port that only allows fluid flow down out of pressure relief valve 250. An annular fluid flow groove 262 extends around power piston 142 and communicates with vent port 260 to allow pressure communication accordingly. Vent port 260 is positioned between outer annular seal 150 (O-ring seal, for example) and another outer annular seal 264.

A plurality of slots 266 are positioned along the inner diameter of power housing section 22, which are adapted to receive seal 264. However, in the alternative, slots 266 may instead be one continuous slot extending around power housing section 22. As will be described herein, when power piston 142 is in the deactivated position (FIG. 2), outer annular seal 264 is energized to effectively seal between power piston 142 and power housing section 22. However, when power piston 142 is in the activated position (i.e., pressure relief valve 250 is activated) (FIG. 1), outer annular seal 264 no longer seals because it has been received along slots 266 wherein vent port 260 is then allowed to communicate pressure around outer annular seal 264.

In addition to activating power piston 142, downward movement of power piston 142 relative to housing 12 due to annular pressure also results in movement of operating mandrel assembly 92, thus moving ball valve 70 to its open position. A rapid increase in well annulus pressure will be immediately transmitted to the upper side 141 of power piston 142, but will be delayed in being communicated with the lower side 143 of power piston 142, so that a rapid increase in well annulus pressure will create a downward pressure differential across power piston 142 thus urging it downward within the housing 12. Accordingly, in this exemplary embodiment, pressure relief valve 250 will not open until power piston 142 is in the activated position which also requires ball valve 70 to be in the open position, thus avoid inadvertent Locked Open tool positions.

To further describe this exemplary embodiment of annular pressure responsive tool 10, lower operating mandrel portion 98 carries a radially outward extending flange 156 having a lower tapered shoulder 158 and an upper tapered shoulder 160 defined thereon. A spring collet retaining mechanism 162 has a lower end fixedly attached to connector section 24 at thread 164. A plurality of upward extending collet fingers 166 are radially inwardly biased. Each finger 166 carries an upper collet head 168 which has the upper and lower tapered retaining shoulders 170 and 172, respectively, defined thereon.

In the initial position of lower operating mandrel portion 98 as seen in FIG. 1D, collet head 168 is located immediately below flange 156 with the upper tapered retaining shoulder 170 of collet head 168 engaging the lower tapered shoulder 158 of the flange 156 of lower operating mandrel portion 98. This engagement prevents operating mandrel assembly 92 from moving downward relative to housing 12 until a sufficient downward force is applied thereto to cause the collet fingers 166 to be cammed radially outward and pass up over flange 156 thus allowing operating mandrel assembly 92 to move downward relative to housing 12. Similarly, subsequent engagement of upper tapered shoulder 160 of flange 156 with lower tapered retaining shoulder 172 of collet head 168 will prevent the operating mandrel assembly 92 from moving back to its upward most position relative to housing 12 until a sufficient pressure differential is applied thereacross. In certain embodiments of the present invention, spring collet 162 is designed so that a differential pressure in the range of from 500 to 700 psi, for example, is required to move the operating mandrel assembly 92 past the spring collet 162. Thus, spring collet 162 prevents premature movement of operating mandrel assembly 92 in response to unexpected annulus pressure changes.

Figure 1E:
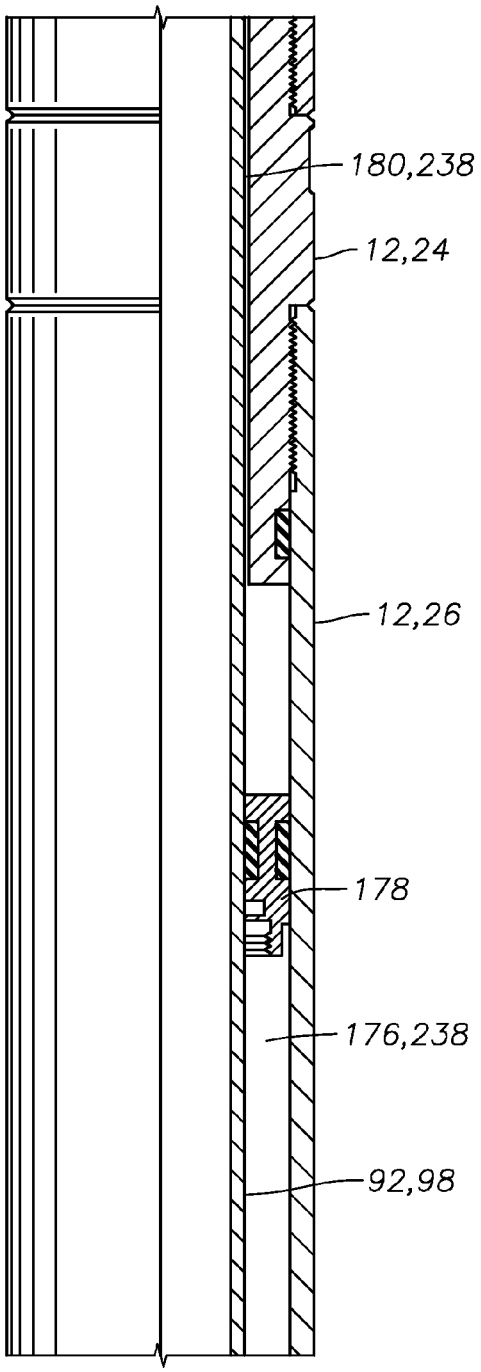
Figure 1F:
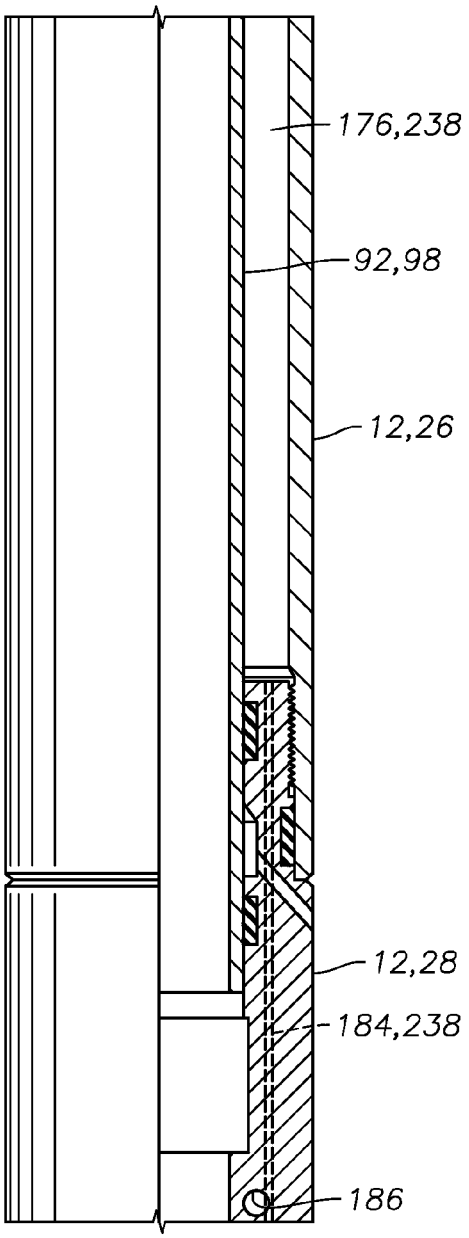
Figure 1G:
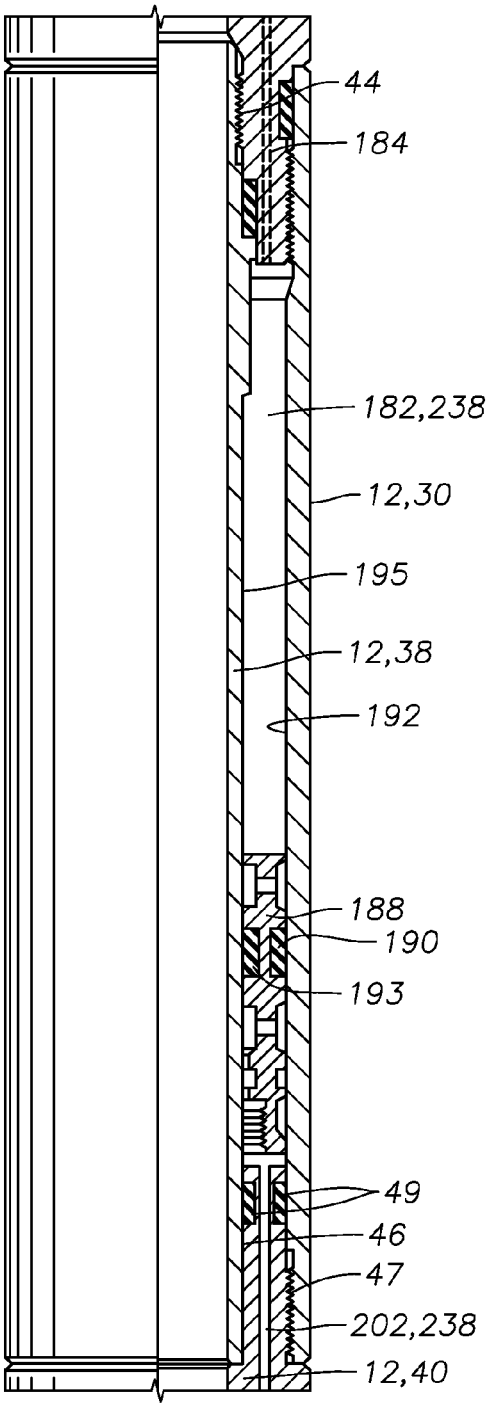

Referring to FIG. 1D, an irregularly shaped annular oil balancing chamber 174 is defined between power housing section 22 and lower operating mandrel portion 98 below power piston 142. Oil balancing chamber 174 is filled with a hydraulic fluid such as oil. As shown in FIG. 1E, an upper annular nitrogen chamber 176 is defined between upper gas chamber housing section 26 and lower operating mandrel portion 98. An annular upper floating piston or isolation piston 178 is slidably received within nitrogen chamber 176, as understood in the art. A plurality of longitudinal passages 180 are disposed through an upper portion of upper gas chamber housing section 26 to communicate oil balancing chamber 174 with the upper end of nitrogen chamber 176. Floating piston 178 isolates hydraulic fluid thereabove from a compressed gas such as nitrogen located therebelow in the upper nitrogen chamber 176.

An annular lower nitrogen chamber 182 is defined between lower gas chamber housing section 30 and upper inner tubular member 38. A plurality of longitudinally extending passages 184 are disposed through gas filler nipple 28 and communicate upper nitrogen chamber 176 with lower nitrogen chamber 182. A transversely oriented gas fill port 186 intersects passage 184 so that the upper and lower nitrogen chambers 176 and 182 can be filled with pressurized nitrogen gas in a known manner. A gas filler valve (not shown) is disposed in gas fill port 186 to control the flow of gas into the nitrogen chambers and to seal the same in place therein. The nitrogen chambers 176 and 182 serve as accumulators which store increases in annulus pressure that enter annular pressure responsive tool 10 through power ports 132 above and through equalizing port 214. The nitrogen accumulators also function to balance the pressure increases against each other and, upon subsequent reduction of annulus pressure, to release the stored pressure to cause a reverse pressure differential within annulus pressure responsive tool 10.

A lower floating piston or isolation piston 188 is slidingly disposed in the lower end of lower nitrogen chamber 182. It carries an outer annular seal 190 which seals against an inner bore 192 of lower gas chamber housing section 30. Piston 188 carries an annular inner seal 193 which seals against an outer cylindrical surface 195 of upper inner tubular member 38. Lower isolation piston 188 isolates nitrogen gas in the lower nitrogen chamber 182 thereabove from a hydraulic fluid such as oil contained in the lower most portion of chamber 182 below the piston 188.

Figure 1H:
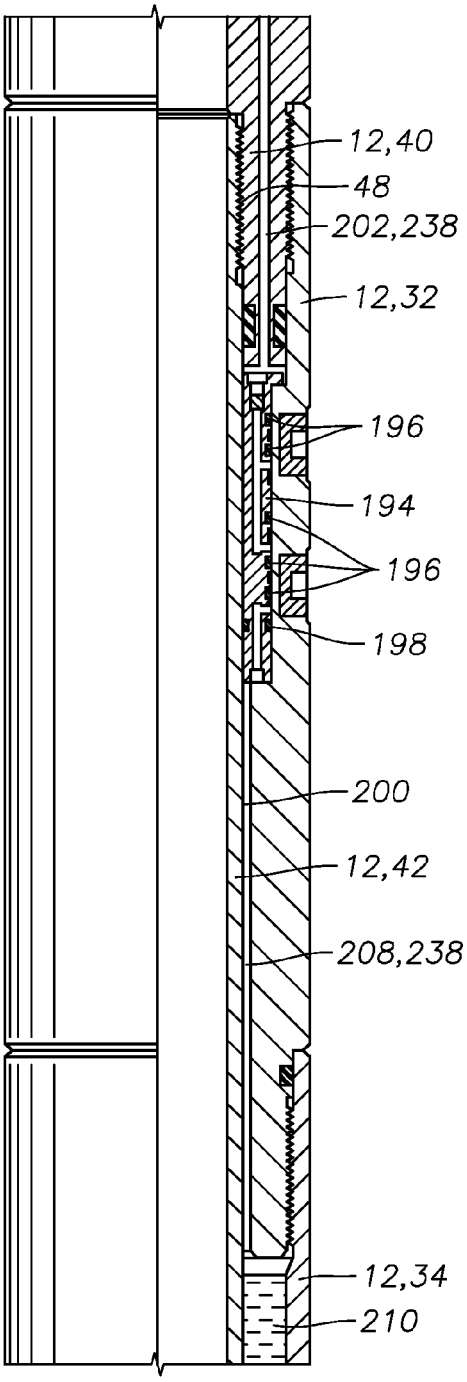

Referring now to FIG. 1H, an annular multi-range metering cartridge 194 is located longitudinally between inner tubular member connector 40 and the metering cartridge housing 32, and is located radially between the metering cartridge housing 32 and the lower inner tubular member 42. Multi-range metering cartridge 194 is fixed in place by the surrounding components just identified and is adjustable to meter fluid over a wide range of differential pressures. Metering cartridge 194 carries outer annular seal 196 which seals against the inner bore of metering cartridge housing 32. Multi-range metering cartridge 194 carries an annular inner seals 198 which seal against a cylindrical outer surface 200 of lower inner tubular member 42. An upper end of multi-range metering cartridge 194 is communicated with the lower nitrogen chamber 182 by a plurality of longitudinal passageways (not shown) cut in the radially outer portion of inner tubular member connector 40. Operation of multi-metering cartridge 194 will not be described herein, as those ordinarily skilled in the art having the benefit of this disclosure will readily understand its function and operation.

Figure 1I:
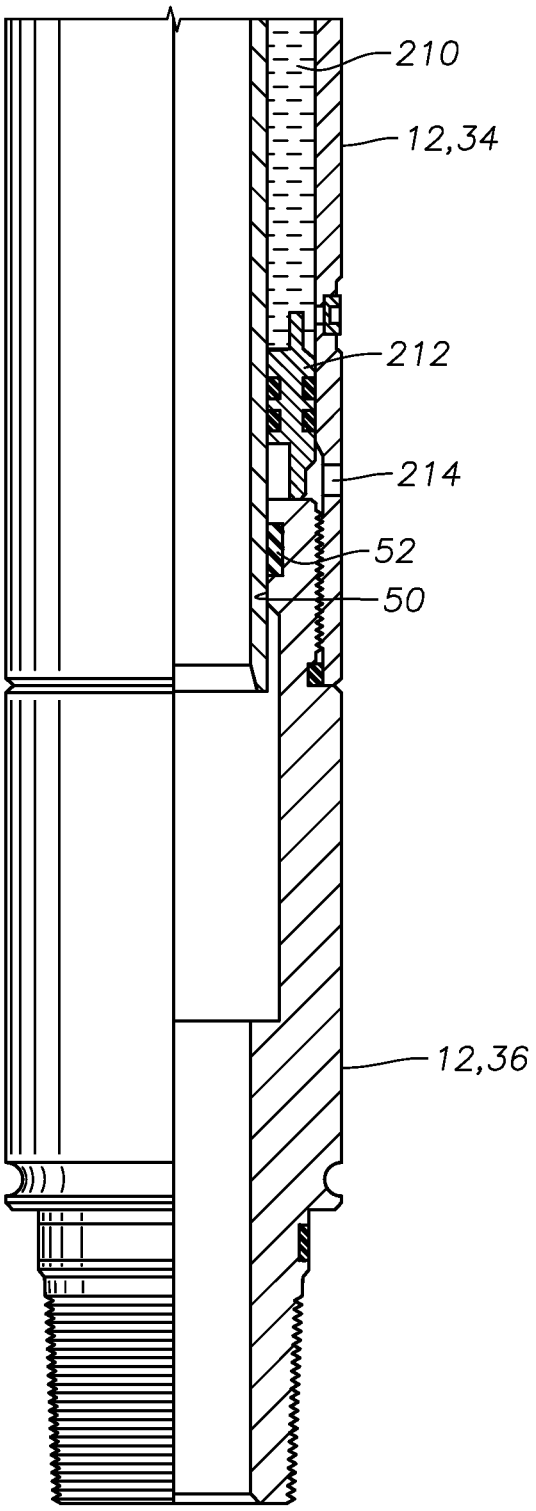

Referring now to FIG. 1I, multi-range metering cartridge 194 communicates with a lower oil filled equalizing chamber 210 via annular passage 208. A lowermost floating piston or isolation piston 212 is slidably disposed in equalizing chamber 210 and isolates oil thereabove from well fluids such as mud which enters therebelow through an equalizing port 214 defined through the wall of lower oil chamber housing section 34.

Referring to FIGS. 1A-1I, housing 12 can be generally described as having a first pressure conducting passage 236 defined therein for communicating the well annulus with the upper side 141 of power piston 142. In certain exemplary embodiments, the first pressure conducting passage 236 includes, for example, power port 132, annular mud chamber 130, and oil power chamber 134. Housing 12 can also be generally described as having a second pressure conducting passage 238 defined therein for communicating the well annulus with the lower side 135 of actuating piston 136. The second pressure conducting passage 238 includes oil power chamber 134, oil balancing chamber 174, longitudinal passage 180, upper nitrogen chamber 176, longitudinal passage 184, lower nitrogen chamber 182, longitudinal passages 202, the flow path 204 of multi-range metering cartridge 194, annular passage 208, equalizing chamber 210 and equalizing port 214. Also, as previously described, once in the activated position, pressure relief valve 250 is designed to relieve pressure from the first flow passage 236 to the second flow passage 238 when the pressure differential therebetween exceeds the pressure rating of pressure relief valve 250.

As understood in the art, multi-range metering cartridge 194 and the various passages and components contained therein can generally be described as a retarding mechanism disposed in the second pressure conducting passage 238 for delaying communication of a sufficient portion of a change in well annulus pressure to the lower side 135 of actuating piston 136 for a sufficient amount of time to allow a pressure differential on the lower side 135 of actuating piston 136 to move the actuating piston 136 upwardly relative to housing 12. Retarding mechanism also functions to maintain a sufficient portion of a change in well annulus pressure within the second pressure conducting passage and permit the differential in pressures between the first and second pressure conducting passages to balance.

Moreover, ball valve 70 can generally be referred to as an operating element operably associated with power piston 142 and actuating piston 136 for movement with power piston 142 between a first closed position and a second open position. However, in other exemplary embodiments, the first position may be open, while the second position may be closed. Those ordinarily skilled in the art having the benefit of this disclosure will realize that this and a variety of other alterations may be embodied within annular pressure responsive tool 10 without departing from the spirit and scope of the present invention.

Now that the various exemplary components of annular pressure responsive tool 10 have been described, an exemplary operation conducted using annular pressure responsive tool 10 will now be described with reference to FIGS. 1A-1I and 2. As will be understood by those ordinarily skilled in the art having the benefit of this disclosure, ball valve 70 may be opened and closed by increasing and decreasing the annulus pressure between hydrostatic pressure and the first level above hydrostatic. Assuming that we begin with well annulus pressure at hydrostatic levels and a closed position of ball valve 70, annular pressure responsive tool 10 is assembled for deployment into the wellbore such that load transfer shoulders 128 are aligned with load bearing shoulders 131. For exemplary purposes only, the first level of pressure above hydrostatic pressure may be 1000 psi above hydrostatic, a sufficient change in annulus pressure from hydrostatic to move ball valve 70 between its open and closed positions. Also by way of example, the second level of pressure above hydrostatic pressure is stated to be 2000 psi above hydrostatic. Pressure relief valve 250, for example, may be designed to be operable at a differential pressure somewhere between those first and second levels, for example, at a pressure differential in the range of 1200 to 1400 psi. When this differential pressure is applied across relief valve 250 (after it is activated), it will open allowing hydraulic fluid to be metered slowly through the fluid restrictor from the oil power chamber 134 to the oil balancing chamber 174, as understood in the art.

Nevertheless, to describe an exemplary operation in more detail, annular pressure responsive tool 10 is made up, deployed downhole and set at a desired location. During its deployment, ball valve 70 and power piston 142 are in a first closed position whereby ball valve 70 is closed and power piston 142 is in a deactivated position as shown in FIG. 2. After annular pressure responsive tool 10 has been set at the desired location, a pressure increase will be imposed upon the well annulus so that the pressure exterior of the housing 12 is brought to the first level above hydrostatic. Fluid pressure will be transmitted into mud chamber 130 through power port 132 and along the first pressure conducting passage 236 to exert pressure upon actuating piston 136 to move actuating piston 136 downwardly. The fluid pressure is transmitted through the fluid within the oil power chamber 134 to the power piston 142 below. At this time, pressure relief valve 250 is in the deactivated positioned because vent port 260 is sealed by seal 150 above and seal 264 below.

As the first level of pressure is applied to the power piston 142, it and operating mandrel assembly 92 are moved downwardly to a second position, whereby seal 264 is de-energized, or unseals, as it moves into slot 266 thus activating pressure relief valve 250. As a result, ball valve 70 is also actuated into an open position. Here, fluid pressure may be communicated through pressure relief valve 250 and vent port 260. Once the fluid exits vent port 260 it may flow around flow groove 262 until it encounters slots 266 whereby the fluid may then communicate on to oil balancing chamber 174.

Once pressure relief valve 250 is in the activated position as shown in FIG. 1D, power piston 142 and pressure relief valve 250 operate as understood in the art, whereby ball valve 70 may be selectively actuated to one or more open positions (Open, Locked Open, etc., for example) in response to changes in the well annulus pressure. For example, the pressure increase within the first pressure conducting passage 236, following downward movement of the power piston 142, is then stored with the nitrogen chambers 176 and 182 via compression of nitrogen gas contained within. An offsetting amount of fluid pressure is then transmitted upward along the second pressure conducting passage 238 through equalization port 214 at the same time that it is transmitted downward along the first pressure conducting passage 236 through power port 132. Ball valve 70 will still open, however, since the retarding mechanism of the multi-range metering cartridge 194 will delay the increase in well annulus pressure from being communicated from longitudinal passages 208 below to longitudinal passages 202 above. As a result of the delay, the pressure within the first pressure conducting passage 236 will be greater than that within the second pressure conducting passage 238 during the delay and permits the ball valve 70 to open. Eventually, the pressure differential between the first and second pressure conducting passages 236,238 will become relatively balanced after a period of time.

When it is desired to close ball valve 70, annulus pressure may be reduced to hydrostatic causing a reverse pressure differential within both the first and second pressure conducting passages 236 and 238 from the stored pressure within the nitrogen chambers 176 and 182. Metering cartridge 194 delays transmittal of the pressure differential downward within the second pressure conducting passage 238 from passages 202 to passages 208, thereby maintaining an increased level of pressure within the upper portions of the second pressure conducting passage 238. The pressure differential upward within first pressure conducting passage 236 urges power piston 142 and actuating piston 136 upwardly at lower side 135. As power piston 142 moves upwardly, the lower end of power piston 142 and seal 264 are moved up out of slot 266, thus reactivating seal 264 to seal against housing 12 and deactivating pressure relief valve 250. Through the resulting load transfer, sleeve 126, ratchet sleeve 127 and shoulder 147, the upward motion is transmitted to the operating mandrel 96, and ball valve 70 is moved back to its closed position.

Moreover, as previously mentioned, while pressure relief valve 250 and power piston 142 are in the activated position, annular pressure responsive assembly 10 may also be placed into a "Locked Open" position, as understood in the art. As such, ball valve 70 is retained in an open position during subsequent changes of well annulus pressure between hydrostatic and the first level above hydrostatic pressure by imposing upon the well annulus a second level of pressure which is above the first level and then reducing the pressure. Here, the well annulus pressure may be changed between hydrostatic and the first level any number of times through use of the ratchet assembly described herein.

Accordingly, through use of the present invention, the pressure relief valve will not open until the power piston 142 is in the activated position, which also requires ball valve 70 to be in the open position. Therefore, inadvertent Locked Open positions which persist in conventional tester valves are avoided. In addition, if the ball valve has a high differential, the operating pressure may be increased without the associated risks. Lastly, tools utilizing the inventive aspects described herein may be utilized by current field personnel, as retraining will not be necessary because the tool will operate as expected in all conditions.

An exemplary embodiment of the present invention provides a pressure responsive downhole tool, comprising a tool housing; a power piston slidably disposed within the tool housing for movement between a first position and a second position, the power piston comprising a first and second seal disposed around an outer diameter of the power piston to provide a seal between the power piston and the tool housing; and a pressure relief valve disposed along the power piston, the pressure relief valve comprising a vent port disposed between the first and second seals; a first pressure conducting passage for communicating a well annulus pressure with the power piston to move the power piston from the first position whereby the vent port is not allowed to vent, to the second position whereby the vent port is allowed to vent; and an operating element operably associated with the tool for movement with the power piston between the first and second positions. In another, the tool housing comprises a slot positioned along an inner diameter of the tool housing to receive the second seal when the power piston is in the second position.

In yet another, the operating element is a ball valve assembly that prevents fluid communication through a bore of the tool in the first position, and allows fluid communication through the bore in the second position. Another further comprises a mechanism to selectively actuate the ball valve assembly to the second position in response to changes in the well annulus pressure. Yet another further comprises a flow groove in fluid communication with the vent port, the flow groove extending around the outer diameter of the power piston. In another, the flow groove is positioned between the vent port and the second seal. Yet another further comprises a second pressure conducting passage for communicating pressure to move the power piston back to the first position.

An exemplary methodology of the present invention provides a method of using a pressure responsive downhole tool, the method comprising setting the tool along a desired location of a well, the tool comprising a power piston slidably disposed within a housing of the tool for movement between a first position and a second position, the power piston comprising a pressure relief valve; and an operating element operably associated with the tool for movement with the power piston between the first and second positions; applying well annulus pressure to the tool to move the power piston from the first position to the second position, thereby activating the pressure relief valve, while also moving the operating element from a closed position to an open position; and selectively actuating the operating element to one or more open positions in response to changes in the well annulus pressure.

In another, selective actuation of the operating element to the one or more open positions is only allowed while the power piston is in the second position. Yet another method further comprises bleeding off the well annulus pressure to allow the power piston to move back to the first position, thereby also moving the operating element back to the closed position. In another, the pressure relief valve is deactivated in the first position.

Another exemplary methodology of the present invention provides a method of using a pressure responsive downhole tool, the method comprising deploying the tool to a desired location within a well; applying well annulus pressure to the tool to move a power piston from a first position to a second position; activating a pressure relief valve of the power piston when the power piston is in the second position; and selectively actuating an operating element of the tool in response to changes in the well annulus pressure. In another, the pressure relief valve is deactivated while the power piston is in the first position. Yet another method further comprises moving the power piston back to the first position. In another, moving the power piston back to the first position further comprises bleeding off the well annulus pressure.

In yet another, activating the pressure relief valve further comprises deactivating an annular seal positioned around the power piston. In another, deactivating the annular seal comprises causing the annular seal to enter a slot along an inner diameter of a tool housing. In yet another, the operating element is in a closed position while the power piston is in the first position, the closed position preventing fluid from passing through a bore of the tool. In another, the operating element is in an open position while the power piston is in the second position, the open position allowing fluid to pass through the bore of the tool. In another, the operating element is a ball valve assembly.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Although various embodiments and methodologies have been shown and described, the invention is not limited to such embodiments and methodologies and will be understood to include all modifications and variations as would be apparent to one skilled in the art. Therefore, it should be understood that the invention is not intended to be limited to the particular forms disclosed. Rather, the intention is to cover all modifications, equivalents and alternatives falling within the spirit and scope of the invention as defined by the appended claims.

What is claimed is:

1. A pressure responsive downhole tool, comprising:

a tool housing;

a power piston slidably disposed within the tool housing for movement between a first position and a second position, the power piston comprising:

a first and second seal disposed around an outer diameter of the power piston to provide a seal between the power piston and the tool housing; and a pressure relief valve disposed along the power piston, the pressure relief valve comprising a vent port disposed between the first and second seals;

a first pressure conducting passage for communicating a well annulus pressure with the power piston to move the power piston from the first position whereby the vent port is not allowed to vent, to the second position whereby the vent port is allowed to vent; and an operating element operably associated with the tool for movement with the power piston between the first and second positions.

2. A tool as defined in claim 1, wherein the tool housing comprises a slot positioned along an inner diameter of the tool housing to receive the second seal when the power piston is in the second position.

3. A tool as defined in claim 1, wherein the operating element is a ball valve assembly that prevents fluid communication through a bore of the tool in the first position, and allows fluid communication through the bore in the second position.

4. A tool as defined in claim 3, further comprising a mechanism to selectively actuate the ball valve assembly to the second position in response to changes in the well annulus pressure.

5. A tool as defined in claim 1, further comprising a flow groove in fluid communication with the vent port, the flow groove extending around the outer diameter of the power piston.

6. A tool as defined in claim 5, wherein the flow groove is positioned between the vent port and the second seal.

7. A tool as defined in claim 1, further comprising a second pressure conducting passage for communicating pressure to move the power piston back to the first position.

8. A method of using a pressure responsive downhole tool, the method comprising:

setting the tool along a desired location of a well, the tool comprising:

a power piston slidably disposed within a housing of the tool for movement between a first position and a second position, the power piston comprising a pressure relief valve; and an operating element operably associated with the tool for movement with the power piston between the first and second positions;

applying well annulus pressure to the tool to move the power piston from the first position to the second position, thereby activating the pressure relief valve by deactivating an annular seal positioned around the power piston, while also moving the operating element from a closed position to an open position; and selectively actuating the operating element to one or more open positions in response to changes in the well annulus pressure.

9. A method as defined in claim 8, wherein selective actuation of the operating element to the one or more open positions is only allowed while the power piston is in the second position.

10. A method as defined in claim 8, further comprising bleeding off the well annulus pressure to allow the power piston to move back to the first position, thereby also moving the operating element back to the closed position.

11. A method as defined in claim 8, wherein the pressure relief valve is deactivated in the first position.

12. A method of using a pressure responsive downhole tool, the method comprising:

deploying the tool to a desired location within a well;

applying well annulus pressure to the tool to move a power piston from a first position to a second position;

activating a pressure relief valve of the power piston by deactivating an annular seal positioned around the power piston when the power piston is in the second position; and selectively actuating an operating element of the tool in response to changes in the well annulus pressure.

13. A method as defined in claim 12, wherein the pressure relief valve is deactivated while the power piston is in the first position.

14. A method as defined in claim 13, further comprising moving the power piston back to the first position.

15. A method as defined in claim 14, wherein moving the power piston back to the first position further comprises bleeding off the well annulus pressure.

16. A method as defined in claim 12, wherein deactivating the annular seal comprises causing the annular seal to enter a slot along an inner diameter of a tool housing.

17. A method as defined in claim 12, wherein the operating element is in a closed position while the power piston is in the first position, the closed position preventing fluid from passing through a bore of the tool.

18. A method as defined in claim 17, wherein the operating element is in an open position while the power piston is in the second position, the open position allowing fluid to pass through the bore of the tool.

19. A method as defined in claim 12, wherein the operating element is a ball valve assembly.

* * * * *